United States Patent [19]

Green

[11] 4,184,433

[45] Jan. 22, 1980

[54] CONVENIENCE CENTER FOR RAILWAY PASSENGER VEHICLE

[75] Inventor: Daniel R. Green, Griffith, Ind.

[73] Assignee: Pullman Incorporated, Chicago, Ill.

[21] Appl. No.: 849,911

[22] Filed: Nov. 9, 1977

[51] Int. Cl.[2] ..... B61D 37/00

[52] U.S. Cl. ..... 105/327; 105/325; 105/345; 108/26; 211/88; 312/272

[58] Field of Search ..... 105/327, 328, 329 R, 105/345, 325, 314, 315, 456; 244/118 R, 118 P; 296/37.1, 37.13, 23 R; 114/270; 108/26, 152; 211/88, 90; 248/311.1 A, 214, 208, 15, 236; 312/245, 250, 272; 220/18, 23.4; 224/29 R, 29.5, 42.42 R, 42.42 A, 42.46 R, 42.46 B, 42.43

[56] References Cited

U.S. PATENT DOCUMENTS

| | | | |
|---|---|---|---|
| 1,625,011 | 4/1927 | Wolfe et al. | 296/37.13 |
| 1,680,668 | 8/1928 | De Boer | 220/18 |
| 1,689,900 | 10/1928 | Williams | 105/345 |
| 1,803,482 | 5/1928 | Mussey et al. | 105/329 R |
| 2,264,637 | 12/1941 | Landell | 105/329 R |
| 2,434,841 | 1/1948 | Dittrich | 105/327 |

*Primary Examiner*—Edward R. Kazenske
*Assistant Examiner*—Frank F. Atwood
*Attorney, Agent, or Firm*—Richard J. Myers

[57] ABSTRACT

A railway passenger vehicle having a side wall mounted, modular shelving unit providing a convenience center for use in carrying or storing glasses, beverages and the like. The convenience center is a modular unit that may be assembled away from the vehicle and easily attached to a wall mounted seat rail during final assembly stages. The unit includes a mounting shell providing a trough that is attached to the seat rail and shaped to conform with the vehicle structure and also shaped to receive a number of storage or table top members that are suitable to receive various items frequently used by passengers. The trough portion of the convenience center includes a light which is powered by a cable that is carried in a hollow section and extends along the length of the convenient center. The light requires no external wiring to be connected through the walls and thus may be easily wired into the vehicle electrical system at the car ends as the convenience centers are installed.

10 Claims, 6 Drawing Figures

CONVENIENCE CENTER FOR RAILWAY PASSENGER VEHICLE

BACKGROUND OF THE INVENTION

1. Field of the Invention

The disclosure pertains generally to railway passenger vehicles such as observation cars or that tupe of railway vehicle where passengers may relax and socialize while observing the country side. In particular, this disclosure pertains to a passenger service shelf which extends alongside the vehicle side walls.

2. Description of the Prior Art

The prior art discloses different arrangements for construction of railway cars wherein passengers may socialize or observe the scenery. These vehicles have been characterized by a construction such as that shown in the *Dittrich,* U.S. Pat No. 2,434,841 (1948) which discloses the usual seating arrangement used in conjunction with tables located on either side of an aisle or walkthrough area. Such a construction is luxurious but objectionable because of the cost involved in materials, installation and maintenance and also because such an arrangement does not provide for a highly efficient use of space and does not provide a table or shelf arrangement which can be easily cleaned and yet securely hold beverages and the like during transit. Further, *Dittrich* does not disclose a lighted area provided by the table top or seating.

SUMMARY OF THE INVENTION

This invention pertains to a railway passenger vehicle of a single level or bi-level construction and having a modular, passenger convenience center located along the vehicle side wall and including a light arrangement with associated wiring contained within the modular convenience center.

In operation, the passenger convenience center provides a mounting shell having a trough including a V-shaped portion with a light and associated wiring installed in the V-shaped portion and having fastener means that attach the V-shaped portion of the shell to a seat support rail which is attached to the side wall unit. Thus, the convenience center may be easily installed in a conventional railway passenger vehicle that is adapted to have seating installed. The seats are omitted and the modular convenience centers are installed thus eliminating the need for a specially constructed car.

After the mounting shell is attached to the railway vehicle, beverage receptacles, shelf units with recesses, ash tray units or the like may be attached to the open portion of the trough with the aid of overlapping ledges which permit these units to be easily snapped into position and to prevent leakage of fluid into the trough member.

These and other objects and advantages of the invention will become apparent to those having ordinary skill in the art with reference to the following drawings, description and claims.

DESCRIPTION OF THE PREFERRED EMBODIMENT

The disclosure herein shows a convenience center that may be used by train passengers in an observation deck area of a bi-level car or in a single level passenger-type vehicle that has had the seats removed and been converted to an observation or dining type of vehicle.

Figure 1:
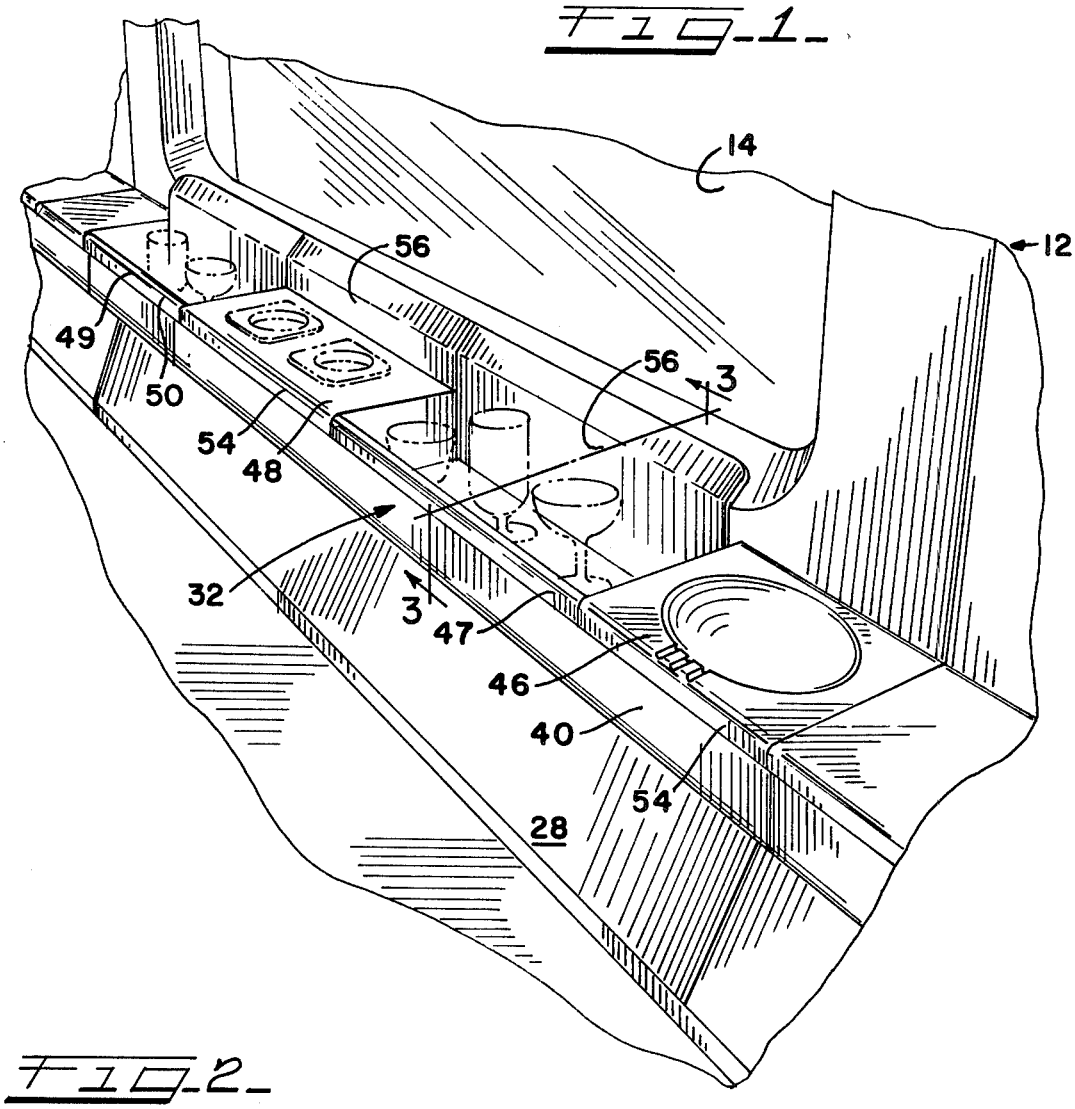
FIG. 1 is a perspective illustration of a portion of a railway vehicle side wall and showing the convenience center disclosed herein.
Figure 2:
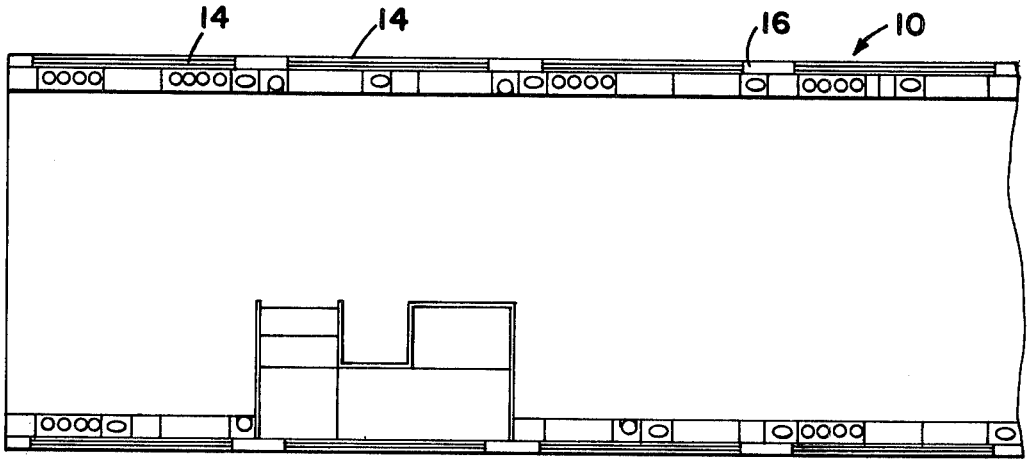
FIG. 2 is a top plan view of a portion of a railway vehicle using the passenger convenience center.

As is shown in FIG. 1, and FIG. 2 a portion of a railway vehicle 10 having a side wall unit 12 which includes a plurality of large windows 14 positioned between upstanding wall framing 16 that provides a rigid side wall structure surrounding each window 14. The side wall construction may include an outer sheet 18 attached to a number of wall posts 10. Extending horizontally between the wall posts 20 is a window sill or rail 22. The rail 22 provides a hollow section 24 (FIG. 3) that provides a tubular type of rigid structure at the window area.

As with any railway passenger vehicle, it is necessary to provide a structural member on the inside of the vehicle that provides a mounting and support for seating. Thus, adapter bracket 26 is rigidly attached to the wall post 20. A cover panel 28 extends downwardly of the bracket 26 to the floor and provides a smooth wall between bracket 26 and the vehicle interior floor.

A seat track 30 is securely attached to the adapter bracket 26 and may extend along the length of the vehicle. Seat track 30 is commonly installed in passenger-type vehicles and provides an attachment point for seats. Thus, a vehicle that is constructed for passengers may easily be adapted or changed, in part or entirely, into a car used for socializing and/or observation. A modular convenience center 32 is mounted alongside each side wall unit and may extend the length of the vehicle or may be spaced conveniently along the side wall as desired. Convenience center 32 has mounting shell 33 with a lower V-shaped trough portion 34 which is attached to the seat track 30 by a fastener 36.

Figure 3:
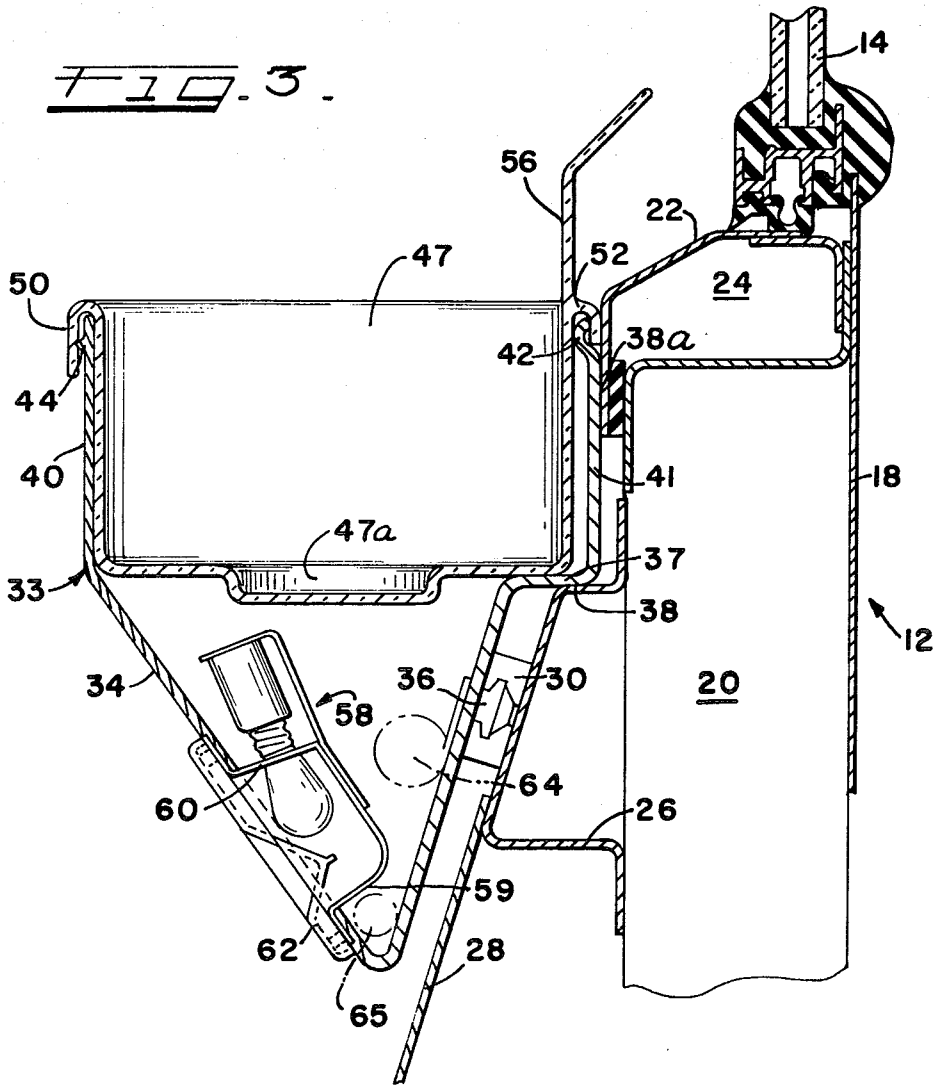
FIG. 3 is a cross-sectional view of the convenience center taken generally along lines 3—3 of FIG. 1.

As shown in FIG. 3, fastener 36 is positioned at an oblique angle, that is, at an angle that is not vertical and is not horizontal. Mounting shell 33 has ledge 37 mounted on a corresponding ledge 38 of adapter bracket 26. Ledges 37 and 38 extend at an angle and in a plane that is different (in this case a horizontal plane) from the angle and plane in which fastener 36 moves. Thus, when fastener 36 is tightened, it moves downwardly and to the right as shown in FIG. 3. When fastener 36 is moving in such a direction, ledge 37 slides over ledge 38 and also bears downwardly on ledge 38 to create a wedging action that firmly attaches the V-shaped section of shell 33 to the adapter bracket 26. When the trough portion 34 is securely attached there is a three-point contact established between the trough portion 34 and the railway vehicle at point 38*a*, at the engagement of ledges 37 and 38, and at the attachment point of the fastener 36.

Extending upwardly from the trough portion 34 is an inner wall 40 and an outer wall 41. Outer wall 41 has a curved top portion 42 that provides a seal along the length thereof. Inner wall 40 has a raised bead 44 extending along its length, also for sealing and fastening purposes.

Located atop the trough portion 34 are a number of receptacles, table tops and tops having recesses. Receptacle 47 provides a recesed area which may be used for storage and transport of drinks and the like. The adjacent table top 48 provides a flat surface for other items needed or carried by passengers (FIG. 1). A second, smaller receptacle 49 may also be conveniently positioned.

Figure 4:
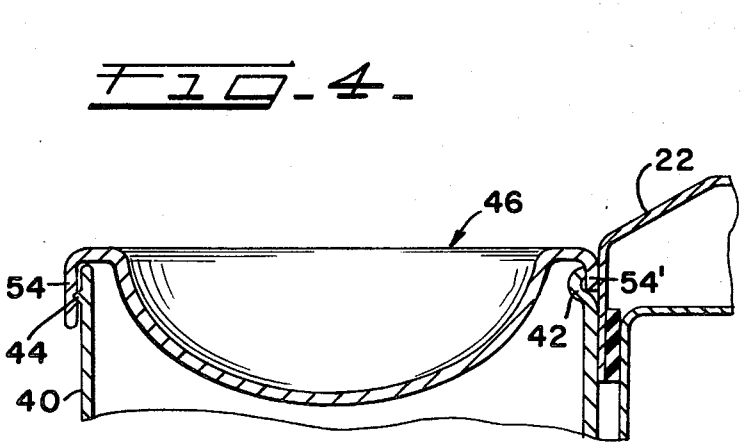
FIG. 4 is a sectional view of one type of attachment that may be used with the convenience center.

Receptacles 47, 49 have an inner lip 50 and an outer lip portion 52 (FIG. 3) to facilitate attachment of the receptacles to the upstanding walls of the trough portion 34. Support surfaces 48 and receptacles 46 may have downwardly depending sides 54, 54' that function in conjunction with bead 44 and the curved top portion 42 to securely hold the associated beverage shelf in place as illustrated in FIG. 4. These overlapping sides also prevent liquid from entering into the trough area.

Receptacles 47, 49 also may have upstanding splash guards 56 to prevent fluids from contacting the side wall and leaking into the wall section or the trough 34.

As shown in FIG. 3, the trough portion 34 of mounting shell 33 includes a light fixture 58. A pair of flexible mounting legs 59, 60 are positioned in a suitable side opening to allow the light fixture to be snapped into position. A lens 62 is used as a cover and to distribute light as needed into the railway car. A wiring arrangement or cable is designated schematically at 64 and 65 to show where the electrical wiring may be located in the hollow portion provided by the V-shaped trough 34. Thus, it is noted that the electrical wiring used for the light fixture 58 is contained within the hollow trough portion 34 and does not extend along the floor or inside the side wall as is done in many conventional railway car constructions. Other electrical wiring for outlets, signs or the like, may also be located in this trough. This arrangement that utilizes the structure of the convenient center for locating electrical wiring allows the wiring to be easily installed and hooked up at the end of the car without the need for extensive car modification.

Figure 5:
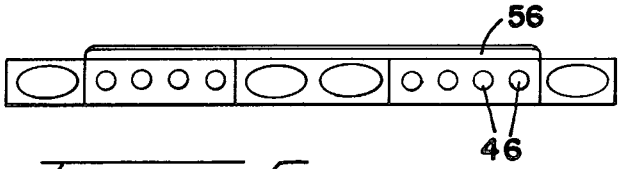
FIG. 5 is a top plan view of one type of modular arrangement using different top portions.
Figure 6:
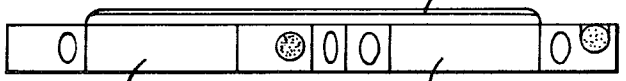
FIG. 6 is a top plan view showing yet another arrangement of table top portions that may be used with the modular assembly.

As shown in FIGS. 5 and 6, the modular construction provided herein permits a variety of receptacles, table tops or other types of members to be used in the railway car. Thus, it may be desirable to have an arrangement such as that shown in FIG. 5 which provides a number of tops having cut-outs or recesses, such as that shown in FIG. 4, for keys, coins or the like while another portion of the car could have an arrangement such as that shown in FIG. 6 which has flat top surfaces 55 or may contain receptacles for holding drinks during transit. Another arrangement that could be provided if, for example, the car has a bar area, could include a number of receptacles such as 47, 49 which would allow drinks to be stored therein.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. In a railway passenger vehicle having a side wall unit with a number of windows contained therein, a passenger convenience center comprising:

said side wall unit including an adapter bracket inwardly upstanding therefrom having a generally horizontal ledge portion and a connector surface extending generally downwardly from said ledge portion;

a mounting shell means for providing a lower hollow portion and said shell means having upstanding leg means providing spaced walls;

implement support means adapted to be removably attached to the mounting shell means to provide a support surface for glasses, bottles and the like;

said upstanding legs of the mounting shell means having means for connecting the implement support means to said shell means to provide a tight, fluid-resistant seal between the mounting shell means and the implement support means;

connector means extending between the mounting shell means and the adapter bracket and providing a connection between same;

said mounting shell means having means cooperative with the ledge portion of the adapter bracket for providing resting and connecting contact between the mounting shell means and the adapter bracket.

2. The invention according to claim 1 and:

said means cooperative with the ledge portion including generally horizontal ledge means extending generally adjacent to said ledge portion of the adapter bracket;

said mounting shell means having a generally V-shaped trough section having a side wall located in a non-vertical, first plane;

said connector surface of said adapter bracket being in a second plane generally parallel with the first plane of the side wall of the trough section; and said connector means comprising tightening means;

said ledge portion of the adapter bracket and the ledge means of said shell being located substantially above said trough and providing for relative, sliding movement therebetween as the side wall of the trough section is moved closer to the adapter bracket under the influence of the tightening means to thereby provide a wedging, gripping connection between the adapter bracket and the mounting shell means.

3. The invention according to claim 1 wherein said support surface includes:

a receptacle having a bottom wall spaced below the top of said upstanding leg means.

4. The invention according to claim 3 wherein said receptacle includes an upstanding splash guard extending above the top portion of the receptacle.

5. The invention according to claim 1 wherein said mounting shell means includes:.

light means with connecting means attaching the light means to the shell means for providing illumination to the area adjacent the convenience center;

said light means including electrical wiring contained with the shell means for providing electrical power to the light means.

6. The invention according to claim 1 wherein said support surface includes;

a generally flat member with recess means extending in a generally vertical plane and having inner and outer lip means overlapping and engaging the top portions of the upstanding spaced walls of the leg members of the mounting shell means.

7. The invention according to claim 1 wherein said support surface includes;

contoured receptacle means including a flat portion extending in a horizontal plane and having a concave, recessed section extending downwardly therefrom to provide a recess.

8. A modular convenience center for use by passengers in a railway passenger vehicle having side wall means, the improvement comprising:

a shell member with first and second walls providing a hollow portion, said first wall having a surface disposed in an oblique direction and;

fastener means for connecting said first wall with the side wall means of said railway vehicle;

said shell member having upstanding leg means extending from said walls;

said shell member also having ledge means;

said ledge means having means extending in a first plane;

said side wall means having cooperating surface means for contact with the ledge means of the shell member to provide a tight connection between the shell member and the railway vehicle when said fastener is tightened;

article support means with means gripping and sealingly engaging the upstanding leg means of the shell member and being positioned within the shell member and including a support surface for support and transport of beverages and the like.

9. The the invention according to claim 8 and:

said support means includes receptacle means having a support wall below the top of said upstanding leg means of the shell member.

10. The modular convenience center of claim 8 wherein said shell member includes:

illumination means; and electrical conduit means positioned within said shell member for conducting electrical current to said illumination means.

* * * * *